United States Patent [19]

McElligott et al.

[11] 4,227,719

[45] Oct. 14, 1980

[54] PROTECTION SYSTEM FOR DOCUMENTS

[75] Inventors: Michael J. McElligott; Victor J. Tkalenko, Jr., both of Rochester, N.Y.

[73] Assignee: Burroughs Corporation, Detroit, Mich.

[21] Appl. No.: 944,233

[22] Filed: Sep. 20, 1978

Related U.S. Application Data

[63] Continuation of Ser. No. 766,590, Feb. 8, 1977, abandoned.

[51] Int. Cl.[3] ..... B42D 15/00

[52] U.S. Cl. ..... 283/8 R; 283/58

[58] Field of Search ..... 283/6–9, 283/57–59, 1, 11, 8 B, 8 R, 17; 355/133; 428/915, 916

[56] References Cited

U.S. PATENT DOCUMENTS

| | | | |
|---|---|---|---|
| 1,428,278 | 9/1922 | Dow | 283/8 B |
| 1,652,042 | 12/1927 | Neff | 428/916 |
| 1,689,302 | 10/1928 | Smith | 283/8 A |
| 1,692,405 | 11/1928 | Freeman | 283/8 B |
| 3,603,681 | 9/1971 | Bortolotti et al. | 352/50 |
| 3,713,861 | 1/1973 | Sharp | 283/6 |
| 3,802,724 | 4/1974 | Gosnell | 283/9 R |
| 3,807,852 | 4/1974 | Hoydic | 355/133 |
| 3,852,088 | 12/1974 | Godlewski et al. | 283/8 B |

FOREIGN PATENT DOCUMENTS

| | | | |
|---|---|---|---|
| 566117 | 12/1944 | United Kingdom | 283/1 R |
| 967735 | 9/1960 | United Kingdom | 283/8 R |

OTHER PUBLICATIONS

Memo of Xerox Corporation, Dated May 25, 1975 from R. F. Lehman to A. Morganstein (Submitted by Applicants in S.N. 766590).

McDonald's Gift Certificate (Submitted by Applicants in S.N. 766590).

Sample of "Kid's Paper" Made by McGhee Printing Service of Stamford, Conn., Copyrighted by Niquette in 1976.

*Primary Examiner*—John McQuade

*Attorney, Agent, or Firm*—Edward J. Feeney, Jr.; Lynn L. Augspurger; Kevin R. Peterson

[57] ABSTRACT

A system to protect documents such as negotiable instruments, title instruments and identification documents from illegal copying by color copiers and alteration such as amount or signature particularly computer printout documents comprising preprinting a "VOID" pattern over the amount and/or signature area of the document in solvent insoluble or color change ink. The VOID is printed with a camouflage pattern overcoating. The camouflage pattern overcoating may be a pattern or solid coating. It may be a coating on the undersurface of the Mylar film overlay of the "VOID". Thereafter the disclosure contemplates adhering the Mylar film to the document to be protected over the amount and/or signature area with cold pressure. Color copying by machine is prevented by the use of colors in the inks which are below the critical density of the copier, so as to verify the authenticity of a document and prevent fraudulent use of a copy.

3 Claims, 7 Drawing Figures

PROTECTION SYSTEM FOR DOCUMENTS

This is a continuation, of application Ser. No. 766,590, filed Feb. 8, 1977, now abandoned.

BACKGROUND OF THE INVENTION

The prior art has developed according to the references cited in U.S. Pat. No. 3,802,724 issued Apr. 9, 1974 and assigned to the assignee of this application.

Prior art techniques, for the most part, have been based upon the utilization of competing chemical formulations which are or may be employed as either an overlay on the top surface of the document to be protected or as an overprinted area on such documents or in some instances as a chemical wash or bath into which the entire paper stock is emersed and from which the document is thereafter preprinted. None of the known techniques has direct application to computerized document protection nor are any of the known prior art systems readily adapted to document protection of computer printouts as hereinafter described.

Improvements of U.S. Pat. No. 3,802,724 related to a combined document using a document protection system for use with high speed data processing equipment such, for example, as high speed printers, which produce visibly legible records from a computer, the document being safeguarded by a pattern of legible warning data camouflaged by a pattern applied to a film covering of the warning date so that if the covering is altered, the warning data will appear.

Since the general quality of printing by such high speed computer printouts is usually fairly poor, it is a relatively easy matter for the document forger or check alterer to raise, change or remove and add the amount and/or signature at will. The same is generally true for the average typewritten document, check, etc. The printing on these materials is generally so inferior that alteration by hand of the amount or signature is accomplished with ease and efficiency by the individual.

The system contemplated in U.S. Pat. No. 3,802,724 employs a high tensile strength, transparent material which is pre-cut in the form of a tape which is or may be produced in a relatively large roll. The transparent material is required to have a friction coefficient sufficient to avoid marking by known means such, for example, as ball point pens, crayons, wax pencils, and the like. The tape is provided with a lightly colored camouflage pattern on one surface which is overcoated with a highly aggressive, pressure-sensitive, adhesive coating. The opposite surface of the transparent tape is coated with a curable colorless silicone resin. The document to which the pressure sensitized tape is to be applied is or may be provided with a lightly colored, so-called VOID pattern of repeating symbology such, for example, as the word "void", "fraud", "cancelled" or some similar designation. Thereafter the tape with the camouflage protective coating is adhesively secured over the area containing the void pattern, thus masking the "void" pattern from the eye while permitting any more darkly colored, printed indicia such, for example, as the number amount in the case of a check or the signature of the payer of the document to be visibly discernable through the tape. The document thus protected cannot be written upon in a protected area with the generally available writing instruments due to the slipperiness of the exposed surface provided by the invention. Attempts at complete or partial removal of the applied tape result in damage to the document, e.g. tearing, mutilitation, holes in the protected area, etc.

Since the advent of quality color xerographic copiers, such as the Xerox L-6500 color copier, copies of documents have posed an ever increasing problem.

The very effective system disclosed in U.S. Pat. No. 3,802,724 can be thwarted by making a color copy of the original and then altering the amount.

In addition, because the systems of color copying are so effective, criminals having access to them may effectively duplicate negotiable bonds, vehicle registrations and title to match them to the stolen vehicle, personal identification documents, and other like documents. As the copier systems proliferate, so does their usage and the opportunity to make nefarious copies.

SUMMARY OF THE INVENTION

It is the principal object of this invention to thwart nefarious copies of instruments of authentication, title identification be they bearer negotiable or non-negotiable, or the like.

The principal protection system of our invention employs a masked warning mask which when copied appears on the copy due to its effective color density being above the color reproductive threshold density of the copier. The mask is of a color density which is below the color reproductive density of the copier. Any overlay of the mask and the warning phrase has a color density exceeding the color reproductive threshold density.

An additional object of our invention contemplates chemical color change of the warning phrase and/or mask should chemical bleaching or other alterations be attempted.

Furthermore, the ink may be formulated so as to bleed upon attempts to chemically alter them.

It is an additional important object, therefore, of this invention to improve the system disclosed in U.S. Pat. No. 3,802,724 and provide a protection system to protect that document against alteration by various well-known means such as ball point pens, cut and paste of the item portion of the document, solvent and mechanical erasure or bleaching of the amount through chemicals, and yet make them color copier proof.

An additional object of the invention is to provide a document protection system which is adaptable for use with a high speed apparatus so that the item to be protected may receive the protective element or material concurrently or simultaneously with the printing of the amount and signature thereof.

Still another object of the invention is to provide a relatively simple document protecting means which may make use of chemical formulations to enhance protection and yet permits the system to be employed by means of simple mechanical applicators such as cold pressure rolls or platens.

It is also an object of the invention to provide a document protection system which produces immediately visible evidence of alteration or fraudulent copying on color copiers regardless of the means used to make such alterations and which, in the basic preferred embodiment, permits the additional protection of other concomitant fraud protection system, both physical and chemical.

DESCRIPTION OF THE INVENTION

As is the case of the earlier patented disclosure, this invention is concerned with protection of negotiable instruments from the hazards of alteration by chemicals, mechanical cutting pen and ink addition to amounts, and general erasure, obliteration, scuffing and other similar means of altering or changing numbers has intrigued and frustrated engineers and laymen alike since the inception of the use of such instruments. Up until the present time the skilled forger or document alterer armed with a scant few chemicals and a reasonable amount of finger dexterity could alter, change, rearrange, or otherwise make over a negotiable document into an instrument whose amount and/or signature had been changed and thereafter pass such document into the commercial money or banking stream almost at will.

Detection of such alteration varies from impossible to ridiculously easy depending upon the skill of the forger. Protection against the known schemes has run the gamut from chemically compounding various papers on which the documents are to be preprinted to using special pens and inks, mechanical checkwriters, special presses, intricate, large type styles, involved chemical overlays which were applied to the document both before and after printing, and certain types of processes more or less related to the decalcomania art. The present invention relies for its novelty on none of these and yet is broadly related to certain of the prior art systems. In any case, the present invention in effect avoids the pitfalls of the prior art while providing an extremely high degree of protection against alterations and particularly against reproductions and alterations using color copiers.

Figure 1:
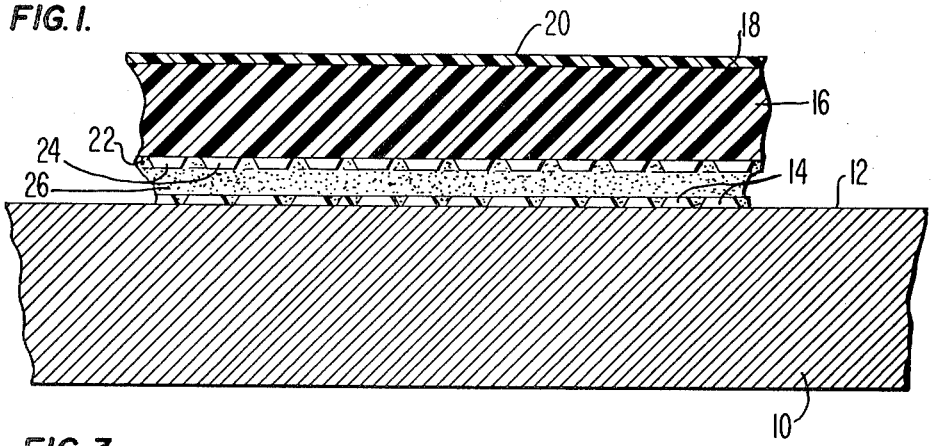
FIG. 1 is a greatly enlarged sectional view in side elevation of the document protection system as applied to a conventional check; which may employ our preferred embodiment.

Referring to the drawings and first to FIG. 1, there is shown a portion of a piece of document material, e.g. check paper, disproportionately enlarged so as to more clearly make discernible the various elements of the combination. The check paper 10 which may vary in thickness from about 0.0035 to 0.007 inch may be printed on the facing surface 12 thereof a printed pattern 14, e.g. the word "VOID" repeated in multiple lines and this word or any similar mark may comprise the warning to at least the cognicenti that its appearance indicates alteration or forgery. A solvent insoluble substrate such, for example, as a polyester film base 16 on the order of 0.001 inch in thickness is preferably provided on one surface 18 thereof with a curable silicone resin plus catalyst coating 20 of 0.0005 to 0.00005 inch thickness. The opposite surface 22 of the polyester substrate 16 is provided with a printed, camouflage pattern 24 which pattern is printed directly on the film base; and, as will be seen later on herein, cooperates with the "VOID" pattern printed on the check in the same color to completely hide or mask the void pattern. Over the surface of the printed camouflage pattern 24 there is applied a coating 26 of a high panel strength, aggressive, solvent and heat resistant, pressure sensitive, adhesive which is approximately 0.0008 to 0.0015 inch in thickness. The ink used to apply the VOID pattern is solvent insoluble; thus if the adhesive is dissolved away by a solvent, the pattern of the "VOID" becomes clearly visibly evident and immediately indicates the fraudulent alternation of the document. In accordance with one preferred embodiment of the invention, the camouflage will have a color density which is below the the color reproductive threshold of the color copier and a warning mark which is above the color density threshold of the color copier.

As can be seen from FIG. 1, the polyester substrate with its multiple layers of material is disposed with the adhesive coating adjacent the "VOID" pattern on the check paper.

Figure 2:
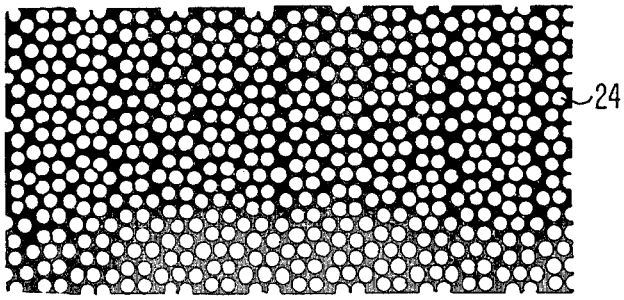
FIG. 2 is a view of the portion of a camouflage pattern for use with the present invention; and its alternative embodiment.

FIG. 2 is illustrative of one type of camouflage pattern 24 which may be used with the void pattern 14 of the present invention. However, it is readily apparent that other patterns may be used provided the end result is that the void pattern printed on the check paper is masked in accordance with our invention thereby so that the pattern is invisible to the unaided eye.

This camouflage may be mask marks in registry for the warning marks or a cover for the warning mask yet it will be of a density such that it is not a reproducible density so that it will not be copied when an attempt is made with a color copier.

Figure 3:
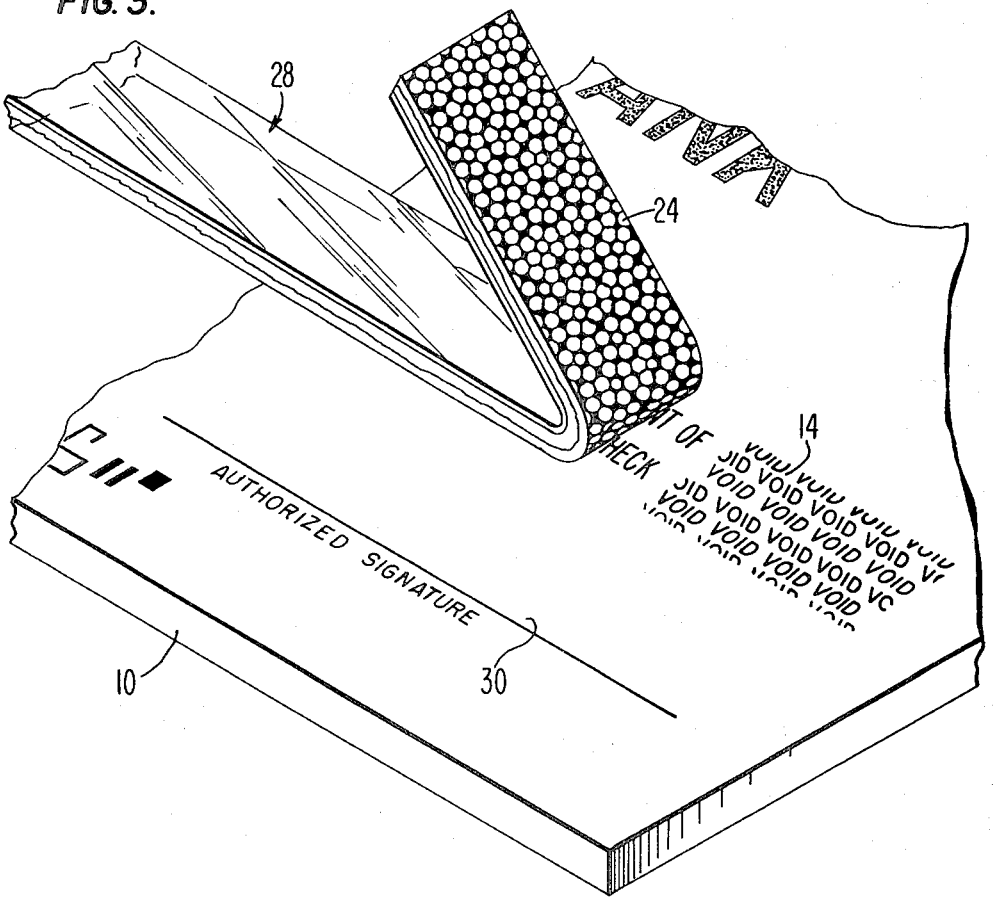
FIG. 3 is an isometric view of the tape protecting layered adhesive assembly in conjunction with a document to be protected.

FIG. 3 illustrates the manner in which the check protection system of the present invention can be employed to protect the amount area of a document, for example, a negotiable instrument such as a check. The layered structure as described in connection with FIG. 1 is produced in the form of a continuous tape or band 28 which may be loaded onto a supply reel and thereafter fed from the supply reel to the printing area of the high speed printer permitting a portion of the tape to be adherred under cold pressure as by a roller and back-up anvil over the amount which has been printed in the amount area over the void pattern which is preprinted on the check structure.

Figure 4:
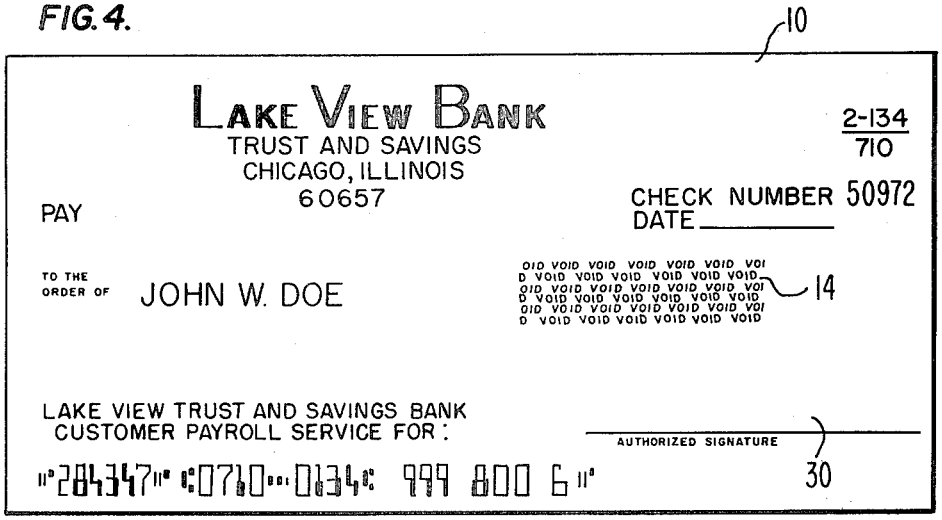
FIG. 4 is a top plan of a conventional check illustrating the "VOID" pattern arranged over the amount area of the check.

An example of a check structure 10 bearing a preprinted void pattern 14 is shown in FIG. 4. This pattern could also be employed in the signature area 30 and the layered tape construction used in similar fashion to its use in the amount area.

Figure 5:
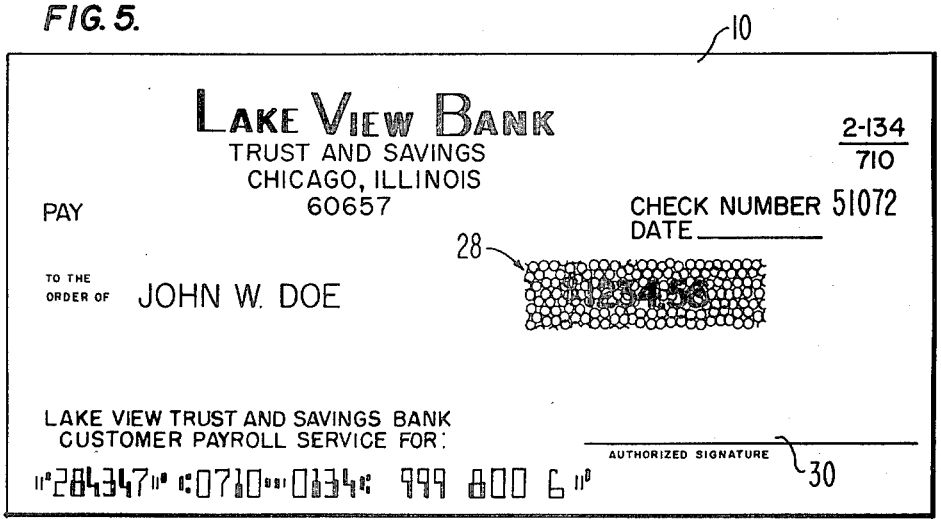
FIG. 5 is a view similar to view 4 illustrating the check protection tape applied over the amount area illustrating the complete camouflage of the void pattern while permitting the amount to be visible through the tape.

FIG. 5 illustrates an example of the finally protected element, in this case a check 10, as it might appear with the protecting tape 28 adherred over the amount awaiting the signature of the payer with the "void" pattern camouflaged but with the amount clearly distinguishable therethrough.

The principal protection system of our invention employs a masked warning mark or phrase which when copied appears on the copy due to its effective color density being above the color reproductive threshold density of the copier. The mask is of a color density which is below the color reproductive density of the copier. Any overlay of the mask and the warning phrase has a color density exceeding the color reproductive threshold density. The color can be formulated from standard press inks.

The threshold density level for these colored inks is: Magenta 0.12±0.01; Cyan 0.08±0.01 and Yellow 0.05±0.01, as read by a Macbeth densitometer RD517. Formulations below these densities will not effectively reproduce on commercial xerographic color copiers such as the L-6500 even with pictorial screens such as 8R537 (Xerox). Densities above this level will reproduce.

Figure 6:
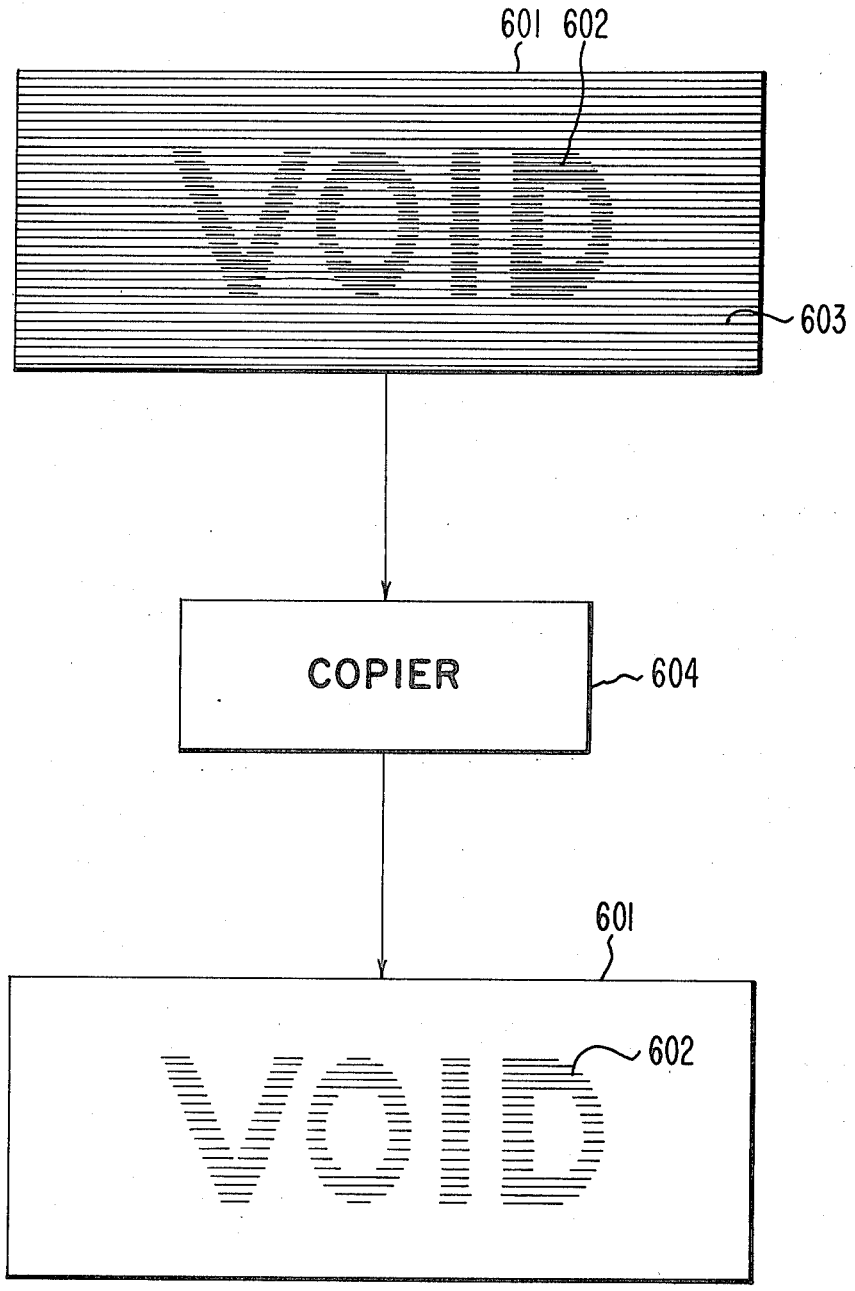
FIG. 6 is a representation of the preferred embodiment of our invention.

Thus in accordance with another preferred embodiment, as seen in FIG. 6, a warning mark "VOID" is laid down or printed at a density level preferably below the aforementioned thresholds. This warning is overlaid with our mask which will be at a density below the aforementioned reproductive threshold densities. The composite density at those places where the warning mark is placed is in accordance with our invention above the aforementioned threshold levels.

Now it should be understood that this invention and its preferred embodiments are difficult to represent within the constraints of the Patent Office's pen and ink drawing requirements.

As illustrated in FIG. 6, the original document 601 has, at least a portion thereof (such as the amount or signature portion), the warning mark ("VOID" 602) printed in red. This is completely covered with a red camouflage 603 of a density below the aforesaid threshold density.

It will be understood that, as may be appreciated from seeing the drawings that the "VOID" mark is camouflaged before being copied. After it is copied, as shown in the FIG. 6 on the L-6500 color copier, 604, the "VOID" mark will be reproduced because the composite density is higher at the point where the warning mark 602 appears.

While, due to the stylized representation in FIG. 6 a solid mark is contemplated, alternate marks can be made.

Figure 7:
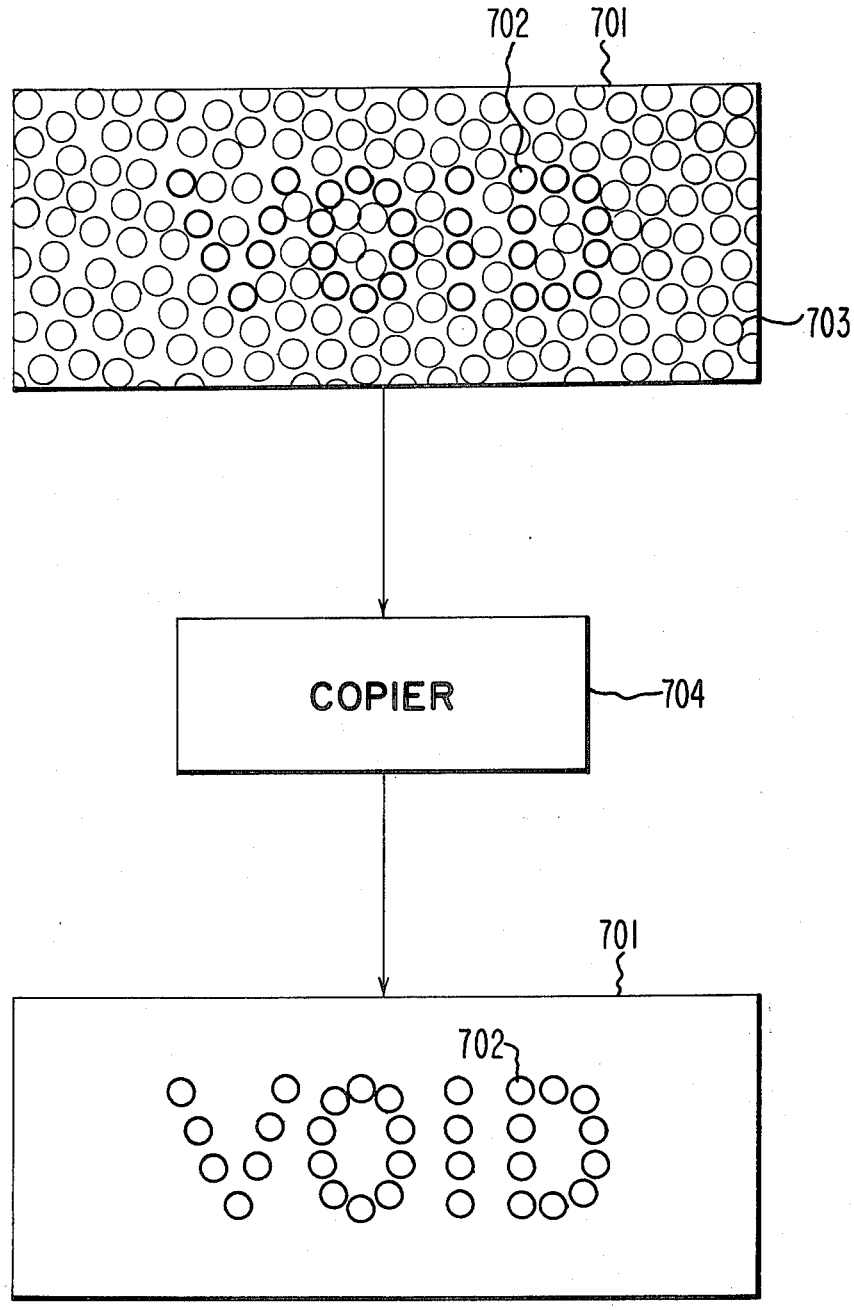
FIG. 7 is an alternative embodiment of our invention.

Representative of these alternate embodiments is FIG. 7. In FIG. 7 the document 701 has the warning mark 702 and camouflage 703 printed thereon. In this embodiment circles (which could be dots, squares, lines or the like) comprise the warning mask 702 and camouflage. The warning mark is of a higher density than the surrounding camouflage and in this embodiment the surrounding camouflage is below the color reproduction threshold density while the color mask, at least in composite density if overpainted with the registered camouflage, is of a density in excess of the threshold density limits.

In the preferred embodiment the "VOID" 602 will be printed with a color change ink solution. A sympathetic ink which turns or gains color and reproductive intensity when exposed to an eradicator is used in the marking mark. In the preferred embodiment, this ink is colorless and may be mixed with the other colored dies or pigments which form the color of the mark and also the mask. Examples of sympathetic inks are "Chlorostain" or liquid (DuPont), "Chlorostain" N (DuPont), "Chlorostain" WH Liquid (DuPont), Oxochekh (Hilton-Davis).

If it is determined that the VOID pattern exists and an attempt is made to eradicate the pattern mark, as from the back of the check in FIG. 1–5, with for instance hypochloride bleach, the ink will darken indicating a forging attempt.

This color pattern will remain and be even more readily reproducible as being above the threshold level of the copies.

Florescent inks and other inks used in conjunction with the threshold level will raise the security of the system by a cumulative nature.

In summary we have described a document and a method of producing it which deters or prevents counterfeiting utilizing the Xerox L-6500 Color Copier or similar machines which possess different color sensitivity than the human eye. Pastels printed below a specified critical level (see above limits) will fail to appear in the copy, while those above the critical density will appear in the copy.

As a result of the described method of manufacture of the document the background overprint or pattern will drop out while the marking phrase or warning mark will be copied.

It should be understood that the above description is made by way of example and that various modifications and rearrangements will occur to those skilled in the art, both now and in the future, without departing from the scope of the claims.

What is claimed is:

1. A document for deterring nefarious color reproduction thereof upon a color copier comprising:

a substrate, a background camouflage printed on the entire area of said substrate of a first density, and a warning mark also printed on said substrate of a second density such that there exists in the area of said warning mark an area of a third density which is cumulative of said first and second densities, such that the third density area is reproduced by a color copying machine, the camouflage and mark being of densities which are not reproduced by a color copying machine.

2. A document according to claim 1 wherein one or both of the background camouflage and the warning mark contain a sympathetic ink which changes color and increases color density when subject to eradicature.

3. A document according to claim 1 wherein a fluorescent substrate is applied with the warning mark.

* * * * *